US005366359A

United States Patent [19]

Bookbinder et al.

[11] Patent Number: 5,366,359

[45] Date of Patent: Nov. 22, 1994

[54] SCROLL COMPRESSOR ORBITAL SCROLL DRIVE AND ANTI-ROTATION ASSEMBLY

[75] Inventors: Mark J. Bookbinder, Detroit, Mich.; Christopher M. Bellinger, Lockport; Michael E. Daniels, Depew, both of N.Y.

[73] Assignee: General Motors Corporation, Detroit, Mich.

[21] Appl. No.: 109,545

[22] Filed: Aug. 20, 1993

[51] Int. Cl.[5] ..... F04C 18/04

[52] U.S. Cl. ..... 418/55.5; 418/57; 418/151

[58] Field of Search ..... 418/55.1, 55.3, 55.5, 418/57, 151; 29/888.022

[56] References Cited

U.S. PATENT DOCUMENTS

| | | | |
|---|---|---|---|
| 2,809,779 | 10/1957 | Girvin | 418/55.3 |
| 2,841,089 | 7/1958 | Jones | 418/55.5 |
| 3,125,032 | 3/1964 | Smith | 418/57 |
| 3,473,728 | 10/1969 | Vulliez | 418/55.3 |
| 3,802,809 | 4/1974 | Vulliez | 418/5 |
| 3,874,827 | 4/1975 | Young | 418/55.5 |
| 4,300,875 | 11/1981 | Fischer et al. | 418/55.5 |
| 4,609,334 | 9/1986 | Muir et al. | 418/55.5 |
| 4,696,630 | 9/1987 | Sakata et al. | 418/57 |
| 4,731,000 | 3/1988 | Haag | 418/55.3 |
| 4,764,096 | 8/1988 | Sawai et al. | 418/55.5 |
| 4,767,293 | 8/1988 | Caillat et al. | 418/55.5 |
| 4,795,323 | 1/1989 | Lessie | 418/55.3 |
| 4,838,773 | 6/1989 | Noboru | 418/55.5 |
| 4,840,549 | 6/1989 | Morishita et al. | 418/55.5 |
| 4,846,639 | 7/1989 | Morishita et al. | 418/55.5 |
| 4,861,245 | 8/1989 | Tojo et al. | 418/55.5 |
| 4,874,302 | 10/1989 | Kobayashi et al. | 418/55.6 |
| 4,886,433 | 12/1989 | Maier | 418/58 |
| 4,892,469 | 1/1990 | McCullough et al. | 418/55.5 |
| 4,927,339 | 5/1990 | Riffe et al. | 418/55.5 |
| 5,011,384 | 4/1991 | Grunwald et al. | 418/55.5 |
| 5,017,107 | 5/1991 | Fraser, Jr. et al. | 418/55.5 |
| 5,247,736 | 9/1993 | Fraser, Jr. et al. | 29/888.022 |

FOREIGN PATENT DOCUMENTS

| | | | |
|---|---|---|---|
| 57-163192 | 10/1982 | Japan | 418/55.3 |
| 63-215892 | 9/1988 | Japan | 418/55.1 |
| 63-248990 | 10/1988 | Japan | 418/55.1 |
| 1273890 | 11/1989 | Japan | 418/55.5 |
| 3210001 | 9/1991 | Japan | 418/55.3 |
| 3260386 | 11/1991 | Japan | 418/55.5 |
| 4-50489 | 2/1992 | Japan | 418/55.5 |

*Primary Examiner*—John J. Vrablik
*Attorney, Agent, or Firm*—Patrick M. Griffin

[57] ABSTRACT

A scroll type compressor 10 having a housing 12, a non-orbital scroll 24, an orbital scroll 22, an orbital scroll drive 50, an anti-rotation assembly 54, and an axial thrust load assembly. The non-orbital scroll 24 is mounted in a rear casing of the housing 12. The orbital scroll 22 cooperates with the non-orbital scroll to form fluid pockets 46 and 48. The orbital scroll 22 is driven by an orbital drive 50 to move the fluid pockets to the center of the scrolls and compress the fluid sealed in the pockets. The anti-rotation assembly 54 includes cups 94 and pins 96 which define a circular orbit that is followed by bearings 104 on pins 100. The scroll drive 50 includes a drawn steel cup 70 that is driven by a drive shaft 82. A first bore 72, with an axis offset from the axis of the drive shaft 82, receives a knuckle bushing 62 which is rotatably attached to the orbital scroll 22. A balance weight 88 is journaled on the orbital scroll 22 and is driven by pin 86. The sliding connection between the cup 70 and the knuckle bushing permits some change in the orbit radius $R_o$ of the orbital scroll 22. The cups 94 are sized relative to the bearings 104 to accommodate changes in the orbit radius $R_o$ of the orbital scroll 22.

2 Claims, 6 Drawing Sheets

SCROLL COMPRESSOR ORBITAL SCROLL DRIVE AND ANTI-ROTATION ASSEMBLY

TECHNICAL FIELD

The invention relates to a scroll type compressor with an orbital-scroll and a non-orbital scroll and more particularly to a drive assembly for an orbital scroll, an anti-rotation assembly for preventing rotation of an orbital scroll and an inertial balancer for balancing the orbital scroll and scroll drive.

BACKGROUND OF THE INVENTION

Scroll compressors have orbital scrolls which are driven in a generally circular orbit. These orbital scrolls include a plate with a flat surface that is perpendicular to an orbit axis and an involute wrap integral with the plate and extending out from the flat surface. A non-rotatable scroll including a plate with a flat surface that is parallel to the flat surface of the orbital scroll and an involute wrap integral with the plate and extending out from the flat surface cooperates with the orbital scroll to form at least a pair of fluid pockets. The fluid pockets are bound by adjacent surfaces of the wraps, line contacts between the wraps and contact between the axial tips of the wraps and the flat surface of the adjacent scroll. A seal is normally provided in a groove in the axial tips of each scroll wrap to seal between the wrap and the flat surface of the adjacent scroll. Axial tip seals are provided to accommodate thermal expansion of the scroll end plates and the scroll wraps.

The orbital scroll is driven to cause the contact lines between the wraps to move along the surface of the wraps toward the center of the scrolls. As the contact lines move, the fluid pockets move toward the center of the scrolls, the pockets become smaller and the fluid in the pockets is compressed. A fluid outlet aperture is provided in the center portion of one of the scrolls.

The compressed fluid in the scroll pockets exerts an axial force on the parallel flat surfaces of the scroll end plates. This force tends to separate the scrolls and cause leakage of compressed fluid between the axial edges of the scroll wraps and the flat surface of the adjacent scroll. The force of compressed fluid also tends to distort the scroll end plates with flat surfaces. The distortion results from the fact that the radial outer edges of the scroll plates are at compressor inlet pressure and the center of the scrolls is at the higher compressor outlet pressure.

Scroll type compressors with a fixed scroll and an orbital scroll are known which hold the orbital scroll in a fixed axial position relative to the axis about which the scroll orbits. The fixed scroll is then subjected to an axial thrust load which moves the fixed scroll toward the orbital scroll.

The orbital scroll is held from rotation and allowed to move in an orbit. The drive means for moving the orbital scroll in an orbit includes a crankshaft. The crankshaft can drive the orbital scroll through a direct connection or it can be connected to the orbital. scroll through a pivoting link or a sliding link that permits some variation in the radius of the scroll orbit. It is desirable to allow some change in the radius of the orbit to keep the scroll wraps in contact with each other, to accommodate normal manufacturing tolerances and to prevent damage to the scroll wraps due to solids mixed with the fluid.

The orbital scroll and scroll drive require balancing to reduce vibration. Balance weights are connected to the crankshaft or in some cases to the links that connect the crankshaft to the orbital scroll.

The inertial forces on a scroll compressor tend to cock the orbital scroll. If the orbital scroll cocks so that its end plate is not parallel to the fixed scroll end plate, scroll efficiency can be reduced and the rate of scroll wear can be increased. The orbital scroll can be held in position by increasing the axial loads on the scrolls, by employing connections between the scroll drive and the orbital scroll which tend to hold the orbital scroll in proper alignment with the fixed scroll and by careful placement of balance weights. The design employed to maintain scroll alignment must be consistent with size, weight and cost considerations.

SUMMARY OF THE INVENTION

An object of this invention is to maintain proper alignment and sealing in the scrolls of a scroll type compressor while minimizing axial thrust loads on the scrolls.

Another object is to provide an anti-rotation assembly which is simple, positive and accommodates limited change in the radius of the scroll orbit.

A further object is to provide a balance weight which is pivotally attached directly to the orbital scroll of a scroll compressor.

A still further object is to provide a simple scroll drive for a scroll compressor which can accommodate changes in the radius of the orbit for the orbital scroll.

The scroll type compressor of this invention includes a non-orbital scroll and an orbital scroll mounted inside a housing. The scrolls include end plates with parallel flat surfaces and involute wraps which cooperate to form pairs of fluid pockets. An orbital scroll drive assembly is journaled in the housing for rotation about a rotation axis and connected to the orbital scroll. An anti-rotation assembly prevents rotation of the orbital scroll relative to the housing and permits limited orbital movement. As the orbital scroll drive assembly propels the orbital scroll, fluid pockets formed by contacts between scroll wraps and end plates move toward the center of the scrolls, the fluid pockets decrease in volume and the fluid in the fluid pockets is compressed. A fluid outlet passage is provided in the center of the non-orbital scroll for the passage of compressed fluid out of the scrolls.

The scroll compressor housing includes a rear casing with a rear wall and side walls. The rear wall includes a continuous flange which acts as side walls of an exhaust chamber. A straight flat baffle plate is secured to the free flat edge of the continuous flange. A gasket is positioned between the continuous flange and the straight flat baffle plate. A baffle plate discharge opening is provided near the center of the baffle plate for the passage of compressed fluid into the exhaust chamber. A compressor discharge port is provided in the rear casing for the delivery of compressed fluid from the exhaust chamber in the compressor housing.

The front side of the baffle plate includes a first continuous pressure chamber flange and a second continuous pressure chamber flange. The wall surfaces of the two pressure chamber flanges are parallel to the rotation axis of the orbital scroll. The non-orbital scroll end plate has grooves cut in its rear side that can telescopically receive the first and second pressure chamber flanges. Spring seals with a v-shaped cross section are placed in grooves in the non-orbital scroll end plate to provide a seal between the edges of the first and second pressure chamber flanges and the scroll end plate. The spring seals accommodate limited axial movement of the non-orbital scroll. One seal that can be used is a spring seal with a v-shaped cross section.

The non-orbital scroll is mounted on pins extending from the rear wall of the rear casing. The pins are parallel to the rotation axis of the orbital. scroll drive assembly, are telescopically received in bores of the non-orbital scroll, and allow axial movement of the non-orbital scroll while preventing movement in other directions.

The first pressure chamber flange on the baffle plate cooperates with the non-orbital scroll to form an inner discharge chamber filled with fluid at discharge pressure. The second pressure chamber flange on the baffle plate cooperates with the non-orbital scroll and the first pressure chamber flange to form a toroidal intermediate pressure chamber. A passage through the non-orbital scroll end plate allows the passage of fluid at an intermediate pressure into the intermediate chamber. The portion of the non-orbital scroll plate that is radially outside the second pressure chamber flange is inside the compressor inlet chamber which is at inlet pressure.

The scroll type compressor of this invention applies an axial thrust load on the central portion of a scroll that is proportional to the outlet pressure of fluid discharged through an outlet passage at the center of the scrolls. The axial thrust load on the intermediate portion of the scroll end plate is proportional to the pressure of fluid in the fluid pockets in the intermediate portion of the scrolls. The axial thrust load on the radially outer portion of the non-orbital scroll is applied by fluid at inlet pressure and is substantially the same as the pressure of fluid in fluid pockets at the radially outer edge of the scrolls.

An anti-rotation assembly, for preventing rotation of the orbital scroll includes four cups mounted in the housing. A pin with an axis parallel to the rotation axis of the orbital scroll drive assembly is positioned in the center of each cup. A bearing on a pin extending from the end plate for the orbital scroll, is positioned within each cup. During orbital movement of the orbital scroll, each of the bearings orbit inside one of the cups and around the pin in the center of each cup. The cups are slightly larger in diameter than required to allow the radius of the scroll orbit to increase or decrease within limits. The bearings attached to the end plate for the orbital scroll cooperate with the stationary cups to permit orbital movement of the orbital scroll and to prevent rotation of the orbital scroll.

An orbiting stub shaft is integral with and extends out of the end plate of the orbital scroll. An inertial balance weight 88 is rotatably mounted on the orbiting stub shaft adjacent the end plate.

A sliding block bushing is rotatably secured to the free end of the stub shaft. A drawn steel cup fits over the sliding block bushing. A first bore in the drawn steel cup is slightly larger in diameter than the sliding block bushing. A flat area on the inside wall of the first bore in the drawn steel cup cooperates with a flat spot on the outer surface of the sliding block bushing to insure that the sliding block bushing rotates with the drawn steel cup. The flat area on the inside wall of the first bore contacts the flat spot on the sliding block bushing at an angle which provides a radial force and a tangential force on the orbital scroll. The tangential force drives the orbital scroll in a generally circular orbit. The radial force urges the scroll wraps into sealing contact with each other.

The sliding block cup includes a hollow shaft with an axis offset from the axis of the bore receiving the sliding block bushing. The hollow shaft is rotatable in the compressor housing. A drive shaft is rotatably journaled in the compressor housing and is positioned inside the hollow shaft. A pin secures the drive shaft to the drawn steel cup and engages the inertial balance weight and rotates it about the axis of the stub shaft that is integral with the orbital scroll.

The drawn steel bushing can slide a limited distance within the drawn steel cup to vary the radius of the orbit for the orbital scroll. The anti-rotation assembly also accommodates changes in the orbit radius. This allows the orbital scroll wrap to move away from the wrap on the non-orbital scroll to accommodate variations in the shape of scroll wraps and to prevent damage to the scrolls.

The foregoing and other objects, features and advantages of the present invention will become more apparent in the light of the following detailed description of exemplary embodiments thereof, as illustrated in the accompanying drawing.

DESCRIPTION OF THE DRAWING FIGURES

BEST MODE FOR CARRYING OUT THE INVENTION

Figure 1:
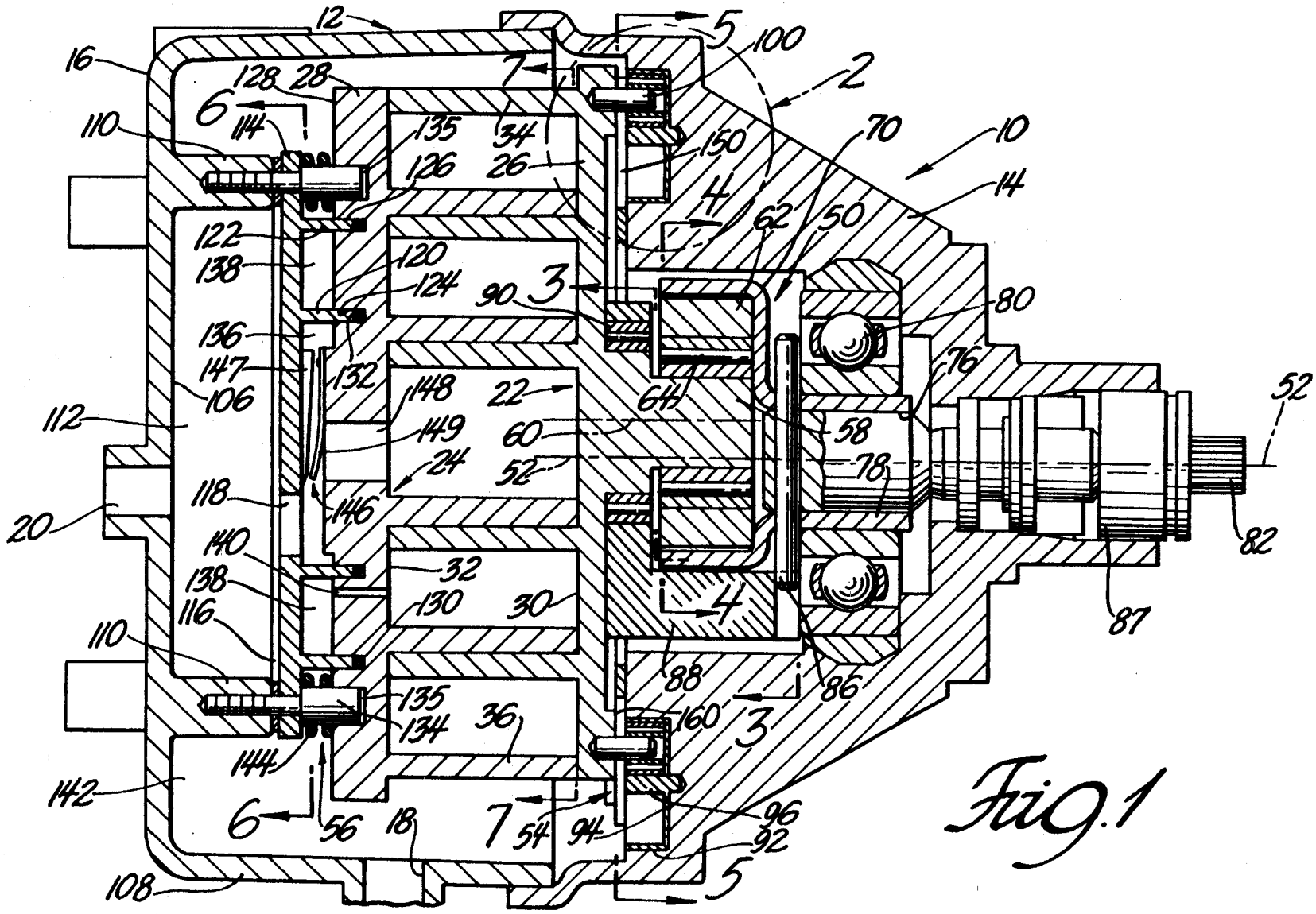
FIG. 1 is a vertical sectional view, with certain parts broken, of a scroll compressor embodying the invention.

The scroll compressor 10, as shown in FIG. 1 includes a compressor housing 12 with a front casing 14 and a rear casing 16. A fluid inlet 18 and a fluid outlet 20 are provided in the housing 12.

Figure 7:
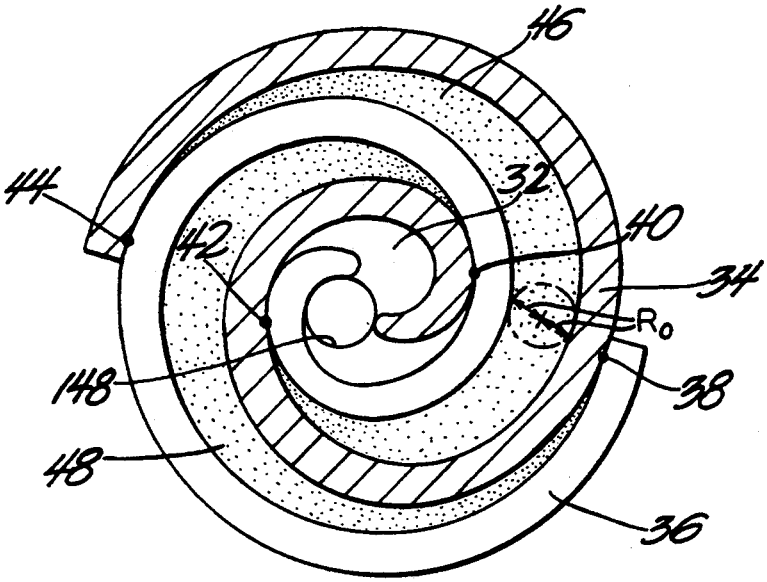
FIG. 7 is a sectional view of the scrolls taken along lines 7—7 of FIG. 1.
Figure 8:
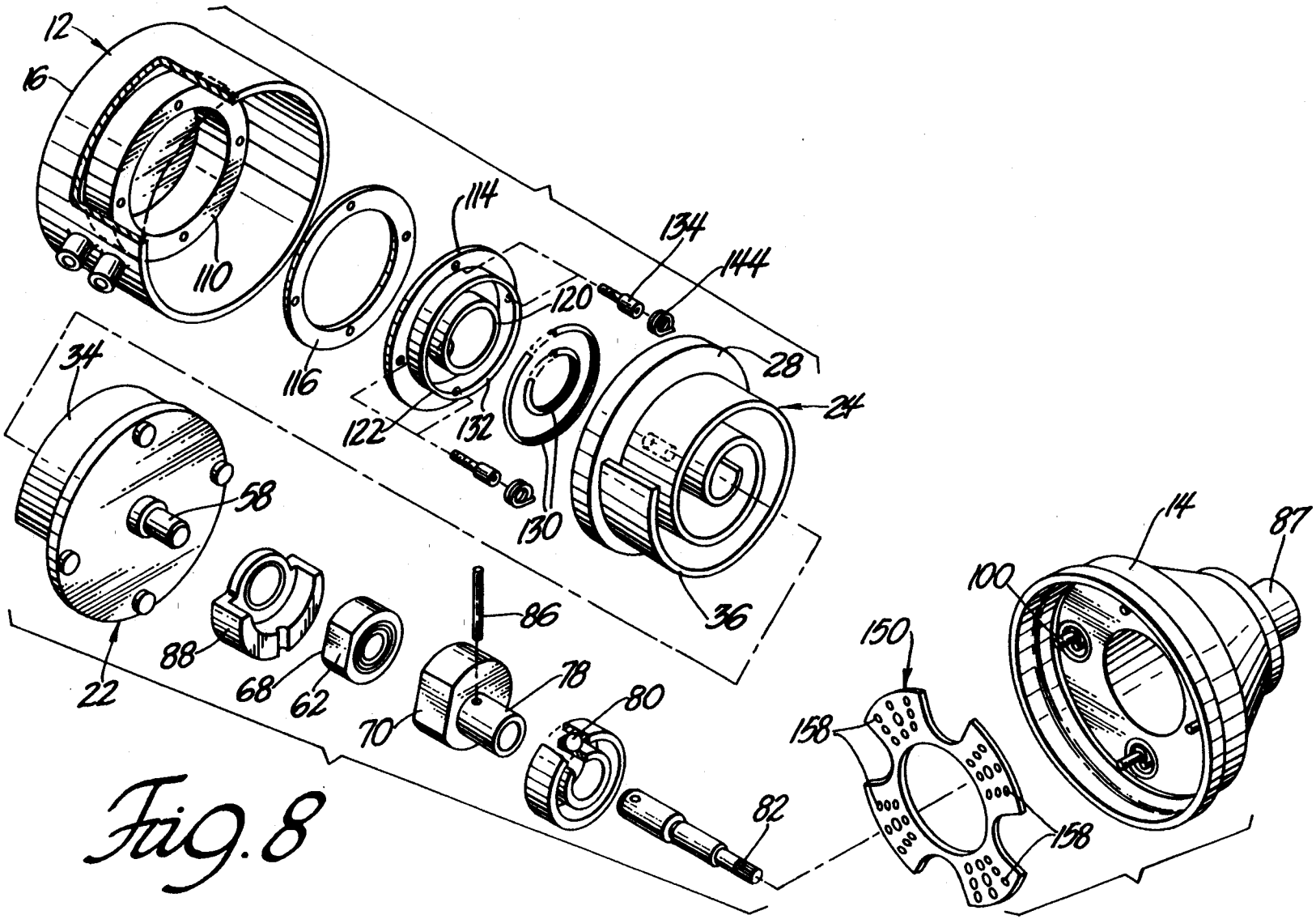
FIG. 8 is an exploded view, reduced in size, of the major working parts of the scroll compressor.
Figure 9:
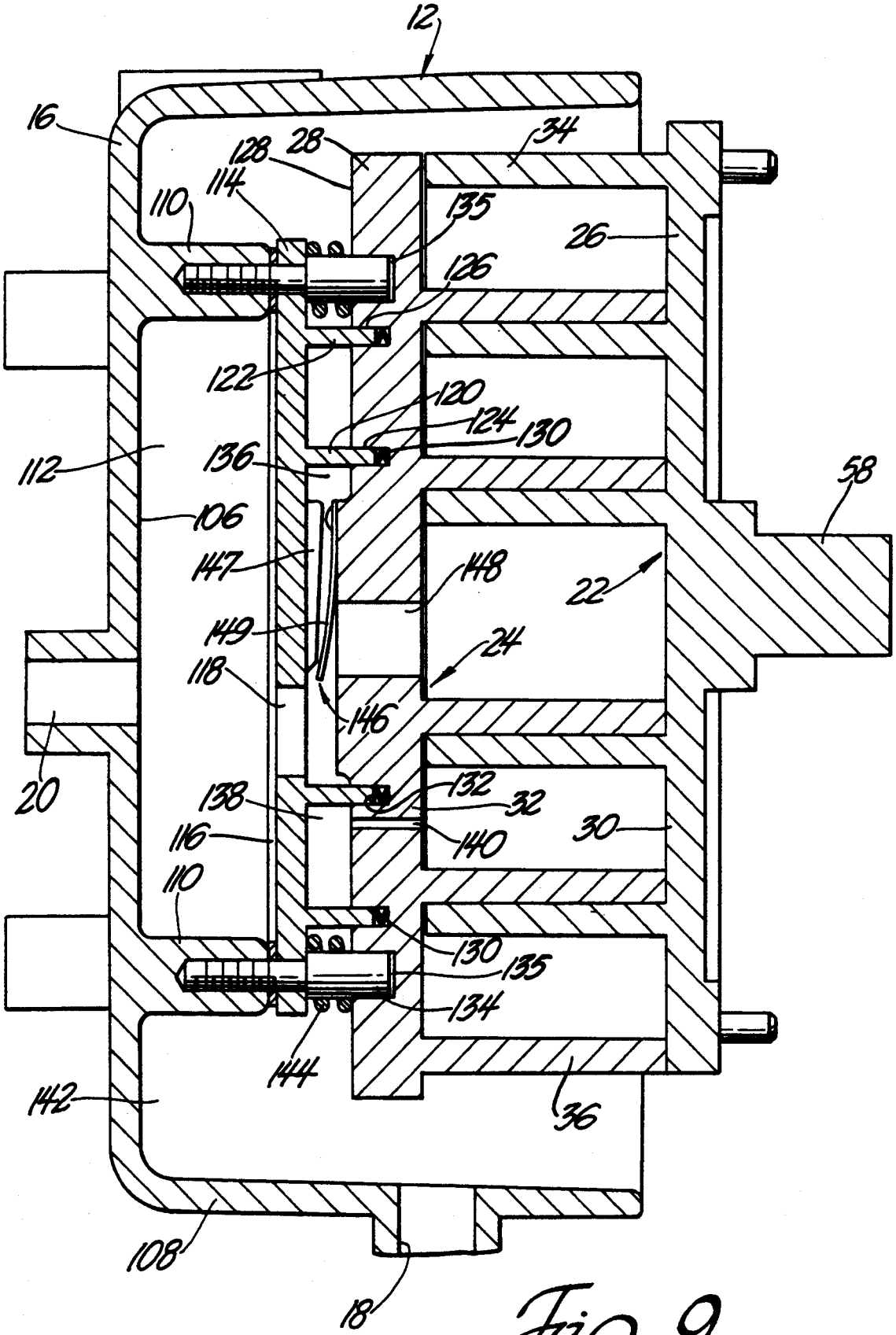
FIG. 9 is an enlarged vertical, sectional view of the scrolls and the axial thrust load applying structure.

An orbital scroll 22 and a non-orbital scroll 24 are mounted within the housing 12. The scrolls 22 and 24 include end plates 26 and 28 with parallel flat surfaces 30 and 32 and involute wraps 34 and 36. The involute wraps 34 and 36 contact each other along contact lines 38, 40, 42 and 44 and the adjacent flat surface 30 and 32 to form closed fluid pockets 46 and 48 shown in FIG. 7.

Figure 2:
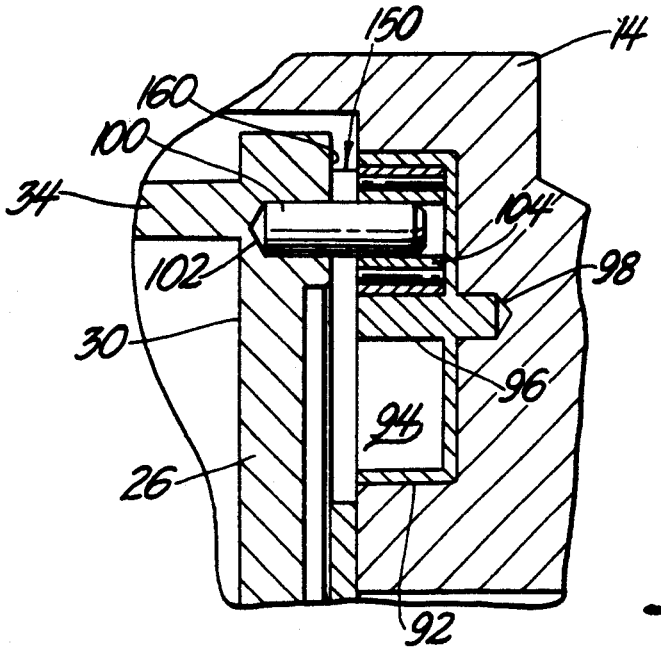
FIG. 2 is an enlarged sectional view of a portion of the orbital scroll anti-rotation assembly shown at 2 in FIG. 1.
Figure 3:
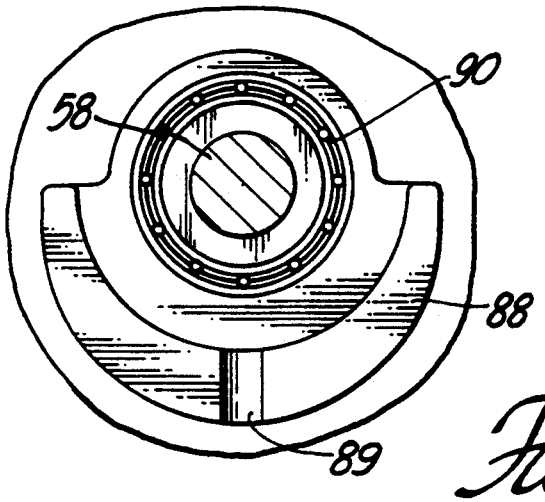
FIG. 3 is a reduced end view of the inertial balance weight and a portion of the orbital scroll taken along lines 3—3 of FIG. 1.
Figure 4:
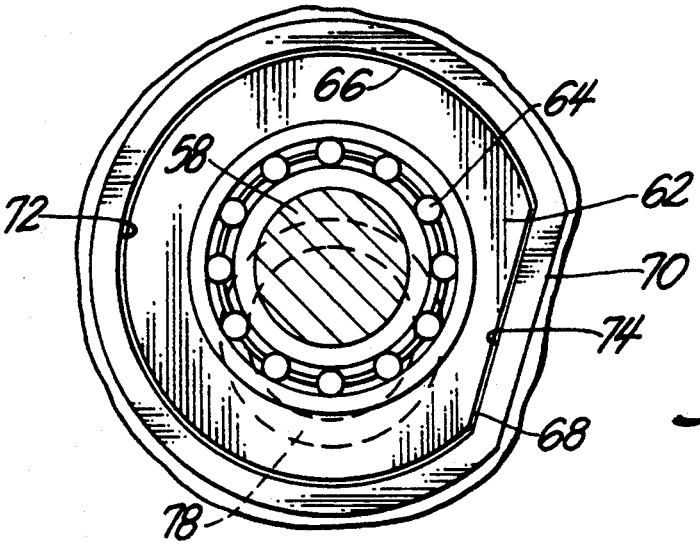
FIG. 4 is an enlarged sectional view of the orbital scroll stub shaft, the sliding block bushing and the drawn steel cup taken along lines 4—4 of FIG. 1.
Figure 5:
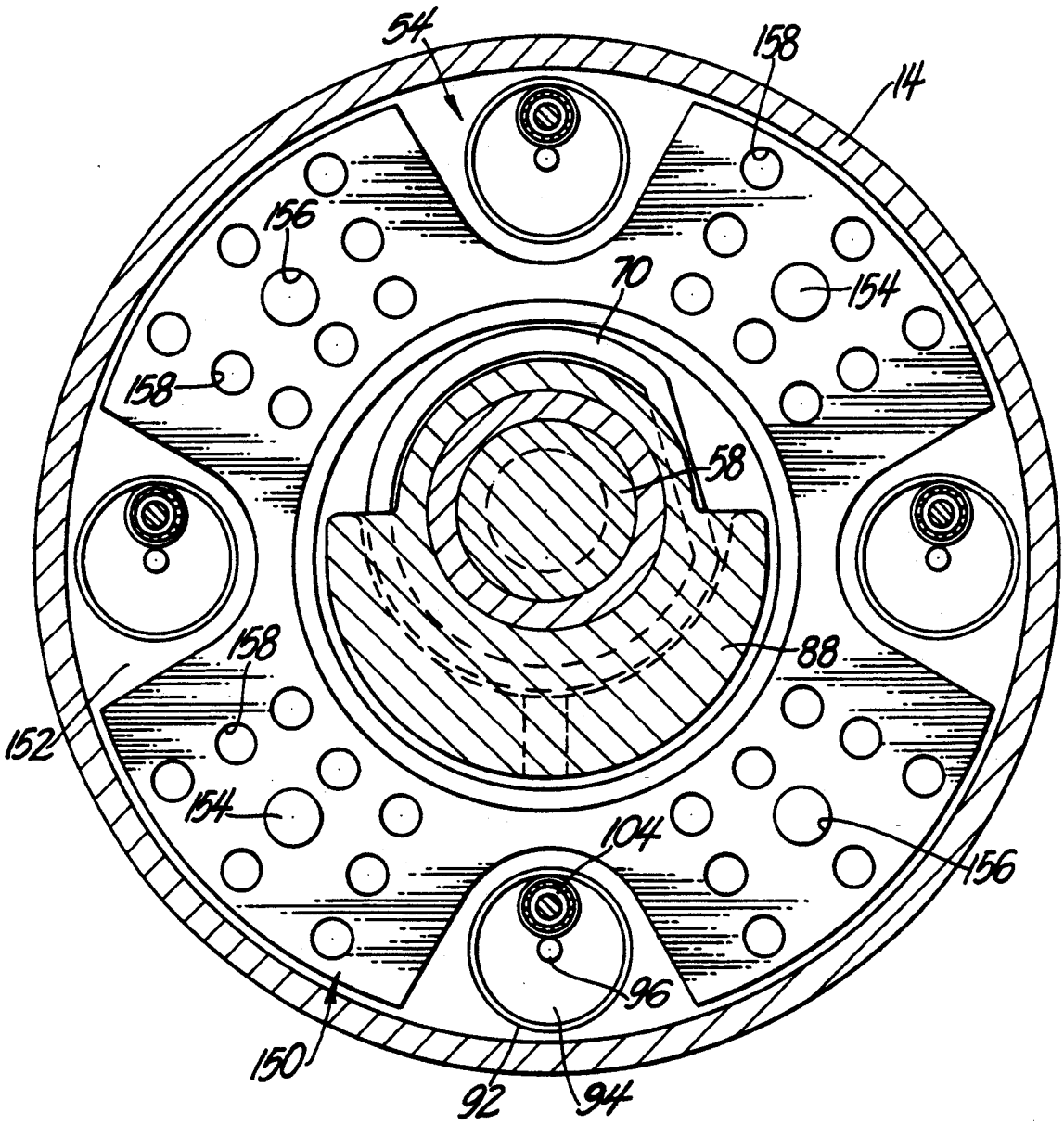
FIG. 5 is a sectional view of the thrust washer and the orbital scroll anti-rotation assembly taken along lines 5—5 of FIG. 1.
Figure 6:
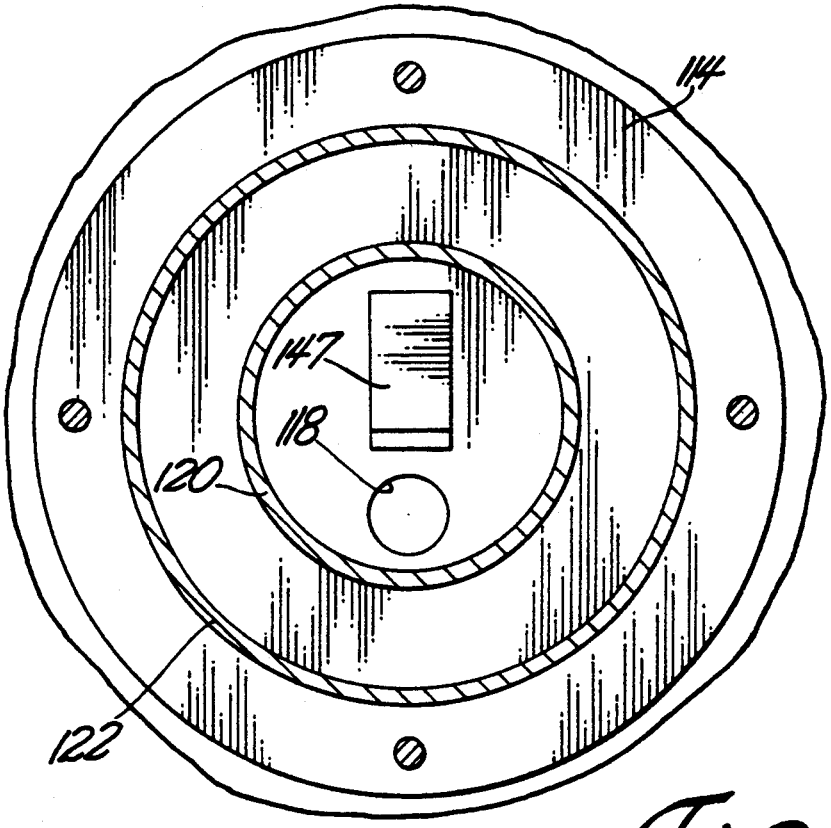
FIG. 6 is a sectional view of a portion of the axial thrust load assembly taken along lines 6—6 of FIG. 1.

A scroll drive assembly 50 is rotatably journaled in the front casing 14 for rotation about the rotation axis 52. An anti-rotation assembly 54 shown in FIG. 2 is mounted in the front casing 14 to prevent rotation and allow orbital movement of the orbital scroll 22 in a circular orbit with a radius $R_o$. An axial thrust load assembly 56 is mounted in the rear casing 16 of the compressor housing 12 for applying an axial thrust load to the scrolls that exceeds the load applied by compressed fluid in the fluid pockets 46 and 48.

The scroll drive assembly 50 includes an orbiting stub shaft 58 that is an integral part of the orbital scroll 22. The centerline 60 of the orbital scroll stub shaft 58 is offset, from the rotation axis 52 a distance equal to the radius of the orbit $R_o$ of the orbital scroll 22. A sliding block bushing 62 is rotatably secured to the stub shaft 58 by a needle bearing 64. The outer edge surface 66 of the sliding block bushing is concentric with the center line 60 of the orbital scroll orbiting stub shaft 58 except for a flat area 68.

A drawn steel cup 70 with a first bore 72 and a flat surface 74 slides over the sliding block bushing 62. The sliding block bushing 62 is slightly smaller than the first bore 72 and the flat surface 74 of the drawn steel cup 70. This clearance allows the sliding block bushing 62 to slide radially in and out to increase or decrease the orbit radius $R_o$ of the orbital scroll 22 to accommodate imperfections in scroll wrap surfaces. This permits the orbital scroll involute wrap 34 to maintain contact with the wrap 36 on the non-orbital scroll 24 and to accommodate imperfections in the shape of wrap surfaces. The clearance also allows a decrease in the orbit radius to accommodate some foreign materials on wrap surfaces. The flat surface 74 in the drawn steel cup 70 contacts the flat area 68 on the sliding block bushing 62 to rotate the sliding block bushing.

The drawn steel cup 70 includes a second bore 76 concentric with the rotation axis 52 that is parallel to and offset from the centerline 60 of the first bore 72 a distance equal to the radius $R_o$ of the orbital scroll 22 orbit. The second bore 76 is defined by a tubular portion 78 that is rotatably journaled in the front casing 14 by a bearing 80 for rotation about an axis that is concentric with the rotation axis 52. A drive shaft 82 is received in the second bore 76 of the drawn steel cup 70. A bearing 87 rotatably journals the drive shaft 82 in the front casing 14 for rotation about an axis that is concentric with the rotation axis 52 of the compressor 10. A pin 86 passes through aligned apertures in the tubular portion 78 of the drawn steel cup 70 and through the drive shaft 82 to lock the two parts together. The free end of the drive shaft 82 extends out of the front casing 14 of the compressor housing 12 so that it can be driven by a power source.

An inertial balance weight 88 is rotatably journaled on the orbital scroll orbiting stub shaft 58 by a needle bearing 90, between the orbital scroll end plate 26 and the sliding block bushing 62. The balance weight 88 is driven by the pin 86, which engages a slot 89 in the balance weight and passes through a hole in the drive shaft 82. The axial location of the center of gravity of the inertial balance weight 88 is near the center of gravity of the orbital scroll 22 and minimizes the moment created by the inertial forces of the orbital scroll and the balance weight by reducing the distance between the inertial forces. By minimizing the moment created by the inertial forces, small counter weights can balance bending loads on the orbital and rotating parts that are perpendicular to the rotation axis 52 and parallel to the inertial forces to provide a static and dynamic force and moment balance along the rotational axis.

The anti-rotation assembly 54 includes four bores 92 in the front casing 14, spaced from the rotation axis 52 and opening toward the orbital scroll 22. A cup 94 is pressed into each bore 92 and a pin 96 is pressed through an opening in the center of each cup 94 and into a bore 98 in the center of each bore 92. The pin 96 could be an integral part of the cup 94, if desired. The pins 96 and the cups 94 cooperate to form a circular track. Pins 100 are pressed into each of the four apertures 102 in the end plate 26 for the orbital scroll 22. A needle bearing 104 is pressed onto the end of each pin 100. Each needle bearing 104 orbits in a circle defined by the toroidal passage inside of the cup 94 and around the pins 96. The four cups 94 and needle bearings 104 prevent rotation of the orbital scroll 22 and allow orbital movement. The inside diameter of each cup 94 is slightly oversized to allow for changes in the radius of the orbital scroll 22 orbit when the sliding block bushing 62 slides in the drawn steel cup 70.

The axial thrust load assembly 56 includes the rear casing 16 with a rear wall 106 and side walls 108. The rear wall 106 includes a continuous flange 110 which acts as side walls of an exhaust chamber 112. A straight flat baffle plate 114 is secured to the free flat edge of the continuous flange 110. A gasket 116 is positioned between the continuous flange 110 and the straight flat baffle plate 114. A baffle plate discharge opening 118 is provided near the center of the baffle plate 114 for the passage of compressed fluid into the exhaust chamber 112.

The front side of the straight flat baffle plate 114 includes a first continuous pressure chamber flange 120 and a second continuous pressure chamber flange 122. The wall surfaces of the two pressure chamber flanges 120 and 122 are parallel to the rotation axis 52. The non-orbital scroll end plate 28 has grooves 124 and 126 cut in its rear surface 128 that can telescopically receive the first and second continuous pressure chamber flanges 120 and 122. Spring seals 130 with a v-shaped cross section are placed in grooves 124 and 126 in the non-orbital scroll end plate 28 to provide a seal between the edges 132 of the first and second continuous pressure chamber flanges 120 and 122 and the scroll end plate 28. The spring seals 130 accommodate limited axial movement of the non-orbital scroll 24 relative to the straight flat baffle plate 114.

The non-orbital scroll is mounted on pin 134 extending from the rear wall 106 of the rear casing 16. The pins 134 are parallel to the rotation axis 52, are telescopically received in bores 135 in the end plate 28 of the non-orbital scroll 24, and allow axial movement of the non-orbital scroll while preventing movement in other directions.

The first pressure chamber flange 120 on the straight flat baffle plate 114 cooperates with the non-orbital scroll 24 to form an inner discharge chamber 136 filled with fluid at discharge pressure. The second continuous pressure chamber flange 122 on the straight flat baffle plate 114 cooperates with the non-orbital scroll 24 and the first continuous pressure chamber flange 120 to form a toroidal intermediate pressure chamber 138. A passage 140 through the scroll end plate 28 allows the passage of fluid, at an intermediate pressure, into the toroidal intermediate pressure chamber 138. The portion of the end plate 28, of the non-orbital scroll 24, that is radially outside the second pressure chamber flange 122, is at compressor housing 12 inlet pressure.

The pins 134 include threaded portions that screw into the continuous flange 110 on the rear wall 106 of the rear casing 16. The pins 134 thus perform the dual functions of holding the baffle plate 114 and the gasket 116 in sealing engagement with the continuous flange 110 and at the same time guiding and restraining the non-orbital scroll 24. Coil compression springs 144 are provided on the pins 134 to bias the non-orbital scroll 24 toward the orbital scroll 22. These springs 144 insure that the scrolls 22 and 24 will compress fluid during start up when there is no fluid pressure in the inner discharge chamber 126 or in the toroidal intermediate pressure chamber 138 to provide an axial thrust load on the end plate 28 of the non-orbital scroll 24.

A reed type check valve 146 is commonly employed to prevent compressed fluid from flowing back into the scroll fluid pockets 46 and 48 through the outlet passage 148, The reed type check valve 146 is shown mounted on the back side of the end plate 28 of the non-orbital scroll 24, The reed type check valve 146 could also be located on the straight flat baffle plate 114 or even outside the compressor housing 12. A ramp 147 on the baffle plate 114 limits movement of the reed 149.

A thrust washer 150 is mounted on the rear surface 152 of the front casing 14. Pins 154 are pressed through apertures 156 through the thrust washer 150 and into apertures in the front casing 14. Additional apertures 158 are provided in the thrust washer 150 to provide pockets for washer lubricant, The thrust washer 150 is preferably made from or coated with a low friction material, A flat surface 160 on the front side of the end plate 26 of the orbital scroll 22 contacts the thrust washer 150 to limit axial movement of the orbital scroll. During operation of the compressor 10, the flat surface 160 on the front of the orbital scroll 22 slides along the surface of the thrust washer 150.

The invention has been described in detail in connection with the preferred embodiment. It will be understood by those skilled in the art that modifications can be made without departing from the scope of the invention.

We claim:

1. In a scroll type compressor including a housing having a central rotation axis, a non-orbital scroll and an orbital scroll, said orbital scroll having an end plate with a generally cylindrical stub shaft that is parallel to and offset from said rotation axis, a drive mechanism for said orbital scroll, comprising, a drive shaft supported within said housing, said drive shaft being substantially coaxial to said rotation axis, a bushing rotatably received on said stub shaft and having an outer edge including a cylindrical portion coaxial to said stub shaft and a flattened portion lying in a predetermined plane, a cup on said drive shaft and having a bore with a cylindrical portion and a flat surface and which is slidably receivable over said bushing with sufficient radial clearance to allow said bore flat surface to slide along said predetermined plane so as to allow compliance between said orbital and non cylindrical scrolls, an inertial balance weight rotatably mounted directly on said stub shaft and against said orbital scroll end plate, between said end plate and said bushing, centrifugally opposed to said stub shaft, and, a connection and drive means fixing said balance weight to said drive shaft so as to drive said weight one to one with said drive shaft, while allowing said cup to slide on said bushing independently of said weight, whereby, said balance weight acts directly on and axially close to said orbital scroll, and will constantly maintain its position relative to said orbital stub regardless of the sliding of said cup on said bushing.

2. In a scroll type compressor including a housing having a central rotation axis, a non-orbital scroll and an orbital scroll having an end plate with a generally cylindrical stub shaft that is parallel to and offset from said rotation axis, a drive mechanism for said orbital scroll, comprising, a drive shaft supported within said housing, said drive shaft being substantially coaxial to and symmetrical about said rotation axis, a bushing rotatably received on said stub shaft and having an outer edge including a cylindrical portion coaxial to said stub shaft and a flattened portion lying in a predetermined plane, a cup separable from said drive shaft and having a sleeve closely slidably receivable over said drive shaft and a bore with a cylindrical portion and a flat surface and which is slidably receivable over said bushing with sufficient radial clearance to allow said bore flat surface to slide along said predetermined plane so as to allow compliance between said orbital and non cylindrical scrolls, an inertial balance weight rotatably mounted directly on said stub shaft and against said orbital scroll end plate between said end plate and said bushing and having a lobe centrifugally opposed to said stub shaft and extending axially past said cup bore to axially overly said cup sleeve, said lobe having a slot therein extending normal to said rotation axis and parallel to said predetermined plane, and, a pin means extending through said cup sleeve, said drive shaft, and through said weight slot to fix said cup rigidly to said drive shaft and also so as to drive said weight one to one with said drive shaft, while allowing said cup to slide on said bushing independently of said weight as said slot slides on said pin, whereby, said balance weight acts directly on and axially close to said orbital scroll, and will constantly maintain its position relative to said orbital stub regardless of the sliding of said cup on said bushing.

* * * * *